US006568298B1

(12) United States Patent
Zinck

(10) Patent No.: US 6,568,298 B1
(45) Date of Patent: May 27, 2003

(54) REVERSIBLE RATCHET HEAD ASSEMBLY

(76) Inventor: Frederick L. Zinck, 600 S. Elmwood Ave., Glenolden, PA (US) 19036

( * ) Notice: Subject to any disclaimer, the term of this patent is extended or adjusted under 35 U.S.C. 154(b) by 0 days.

(21) Appl. No.: 09/856,523

(22) PCT Filed: Nov. 23, 1999

(86) PCT No.: PCT/US99/28057

§ 371 (c)(1),
(2), (4) Date: May 22, 2001

(87) PCT Pub. No.: WO00/32358

PCT Pub. Date: Jun. 8, 2000

Related U.S. Application Data

(60) Provisional application No. 60/109,429, filed on Nov. 23, 1998.

(51) Int. Cl.[7] ..... B25B 13/46

(52) U.S. Cl. ..... 81/57.13; 81/57.29; 81/63

(58) Field of Search ..... 81/57.13, 57.29, 81/61–63, 58.1, 63.2; 192/43.1

(56) References Cited

U.S. PATENT DOCUMENTS

| | | | |
|---|---|---|---|
| 3,233,481 | A | 2/1966 | Bacon |
| 3,529,498 | A | 9/1970 | Northcutt |
| 4,528,873 | A | 7/1985 | Lee |
| 4,532,832 | A | 8/1985 | Christensen |
| 4,974,475 | A | 12/1990 | Lord et al. |
| 5,231,901 | A | 8/1993 | Putney et al. |
| 5,562,015 | A | 10/1996 | Zinck |

OTHER PUBLICATIONS

International Search Report, PCT/US99/28057, Jun. 8, 2000.

International Search Report, PCT/US00/24229, Jan. 16, 2001.

*Primary Examiner*—D. S. Meislin
(74) *Attorney, Agent, or Firm*—Senniger, Powers, Leavitt & Roedel

(57) ABSTRACT

A reversible ratchet head assembly includes a reversal actuator which is received in an opening in an output shaft assembly of a tool. The output shaft assembly carries a pawl which pivots on the output shaft assembly between two positions, one permitting driven rotation of an output shaft of the output assembly in a clockwise direction, and the other permitting driven rotation in a counterclockwise direction. In each position, the pawl permits the tool to be turned in the direction opposite the driven direction for ratcheting operation of the tool. When the direction of rotation is reversed in a powered tool, the reversal actuator moves relative to the output shaft assembly and engages the pawl to automatically switch the pawl from one position to the other. The reversal actuator has two spring-biased fingers which alternatively engage the pawl to move it into one position or the other. The ratchet assembly may also be applied to tools which rely on manual reversal of the pawl.

20 Claims, 4 Drawing Sheets

REVERSIBLE RATCHET HEAD ASSEMBLY

BACKGROUND OF THE INVENTION

This invention relates generally to ratchet mechanisms and more particularly to a reversible ratchet head assembly.

Reversing ratchet mechanisms are widely employed in both hand and powered tools. Some tools employ a combination of powered and manual operation. In those tools, for manual operation, a ratchet mechanism is used so that the tool works like a conventional manual ratchet tool. All ratcheting mechanisms use a pawl engageable with ratchet teeth to fix the tool and an output shaft together for conjoint rotation in one direction and to permit relative rotation of the tool relative to the output shaft in another, opposite direction. The direction in which relative rotation is permitted and prevented can be reversed by changing the position of the pawl. Reversal is typically achieved in hand tools, and also in many powered tools, by turning a knob to move the pawl to a different position. Conventionally, the direction the knob is turned is opposite to the direction in which the output shaft will be driven when the tool is used. Thus, there can be some confusion for the operator as to which way to turn the knob because the knob is turned in the direction opposite the direction of the desired driving rotation of the output shaft. An example of a powered tool having such a ratchet reversing mechanism is shown in U.S. Pat. No. 3,529,498. The tool shown in this patent uses an oscillating yoke connected to an output shaft through the pawl.

Certain powered tools reverse the direction of the pawl automatically when the direction of the motor is reversed. An example of such an automatic ratchet reversing mechanism is shown in my U.S. Pat. No. 5,562,015, the disclosure of which is incorporated herein by reference. My prior tool is of the type which permits manual ratcheting operation of the tool when the resistive torque of the fastener being tightened or loosened is greater than can be overcome by the motor. The tool can be turned manually to supply a greater torque to the fastener to overcome its resistence. The position of the pawl is changed by axial movement of a pawl reverser gear (25) which briefly engages a pawl (35) to toggle it from one position to another. The axial movement of the pawl reverser gear is actuated by a change in direction of the motor and the direction in which the pawl is toggled is controlled by the direction of rotation of the motor. The different positions of the pawl permit driven rotation in different directions during manual operation of the tool. The operation of this tool has been most satisfactory. However, the reversing mechanism does require some space within the housing to allow for axial movement of the pawl reverser gear. Accordingly, it would be desirable to have an automatic reversing mechanism of a more compact configuration.

SUMMARY OF THE INVENTION

Among the several objects and features of the invention may be noted the provision of a reversible ratcheting head assembly which is compact in construction; the provision of such a reversible ratcheting head assembly which is capable of operation at higher speeds; the provision of such a reversible ratcheting head assembly which can be directly driven by a motor; the provision of such a reversible ratcheting head assembly which clearly indicates to the operator the direction of driven rotation upon changeover of the direction of driven rotation; and the provision of a ratcheting head assembly which is economical to manufacture and easy to use.

Further among the several objects and features of the present invention may be noted the provision of a powered tool having the features set forth above.

Generally, a reversible ratchet head assembly comprises a head and ratchet teeth disposed internally of the head. A reversal actuator mounted for rotation in the housing is attached to an output shaft assembly in the head for rotation of the reversal actuator relative to the output shaft assembly. The output shaft assembly further comprises a ratchet pawl pivotally mounted on the output shaft assembly and engageable with the ratchet teeth on the head. The pawl is pivotable between a first position in which the pawl engages the ratchet teeth to hold the output shaft assembly and head together for conjoint rotation in a first direction and to permit relative rotation between the output shaft assembly and the head in a second direction, and a second position in which the pawl engages the ratchet teeth to hold the output shaft assembly and head together for conjoint rotation in the second direction and to permit relative rotation between the output shaft assembly and the head in the first direction. The reversal actuator is constructed to engage the pawl upon rotation of the reversal actuator relative to the output shaft assembly in the first direction to move the pawl to the first position and constructed to engage the pawl upon rotation of the reversal actuator relative to the output shaft assembly in the second direction to move the pawl to the second position.

In another aspect of the present invention, a powered tool capable of operating as a manual ratchet tool generally comprises a housing including a head and ratchet teeth disposed internally of the head, and a reversible motor in the housing. A reversal actuator mounted in the housing is operatively connected to the motor to be driven in rotation by the motor. An output shaft assembly generally in the head of the housing is attached to the reversal actuator for rotation of the reversal actuator relative to the output shaft assembly in a first direction over an arc and for conjoint rotation with the reversal actuator in the first direction after rotation over the arc in the first direction, and for rotation of the reversal actuator relative to the output shaft assembly in a second direction opposite the first direction over the arc and for conjoint rotation with the reversal actuator in the second direction after rotation over the arc in the second direction. Thus, the attachment of the output shaft assembly to the reversal actuator allows rotation of the reversal actuator relative to the output shaft assembly over the arc to occur upon reversal of the motor. The output shaft assembly further comprises a ratchet pawl pivotally mounted on the output shaft assembly and engageable with the ratchet teeth on the head. The pawl is pivotable between a first position in which the pawl engages the ratchet teeth to hold the output shaft assembly and head together for conjoint rotation in one direction and permit relative rotation between the output shaft assembly and the head in another direction opposite said one direction, and a second position in which the pawl engages the ratchet teeth to hold the output shaft assembly and head together for conjoint rotation in said other direction and to permit relative rotation between the output shaft assembly and the head in said one direction thereby to permit manual ratcheting operation of the tool. The reversal actuator is adapted to engage the pawl for pushing the pawl between said first and second positions upon relative rotation between the output shaft assembly and the reversal actuator whereby manual ratcheting is automatically reversed upon reversal of the motor.

Other objects and features of the present invention will be in part apparent and in part point out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
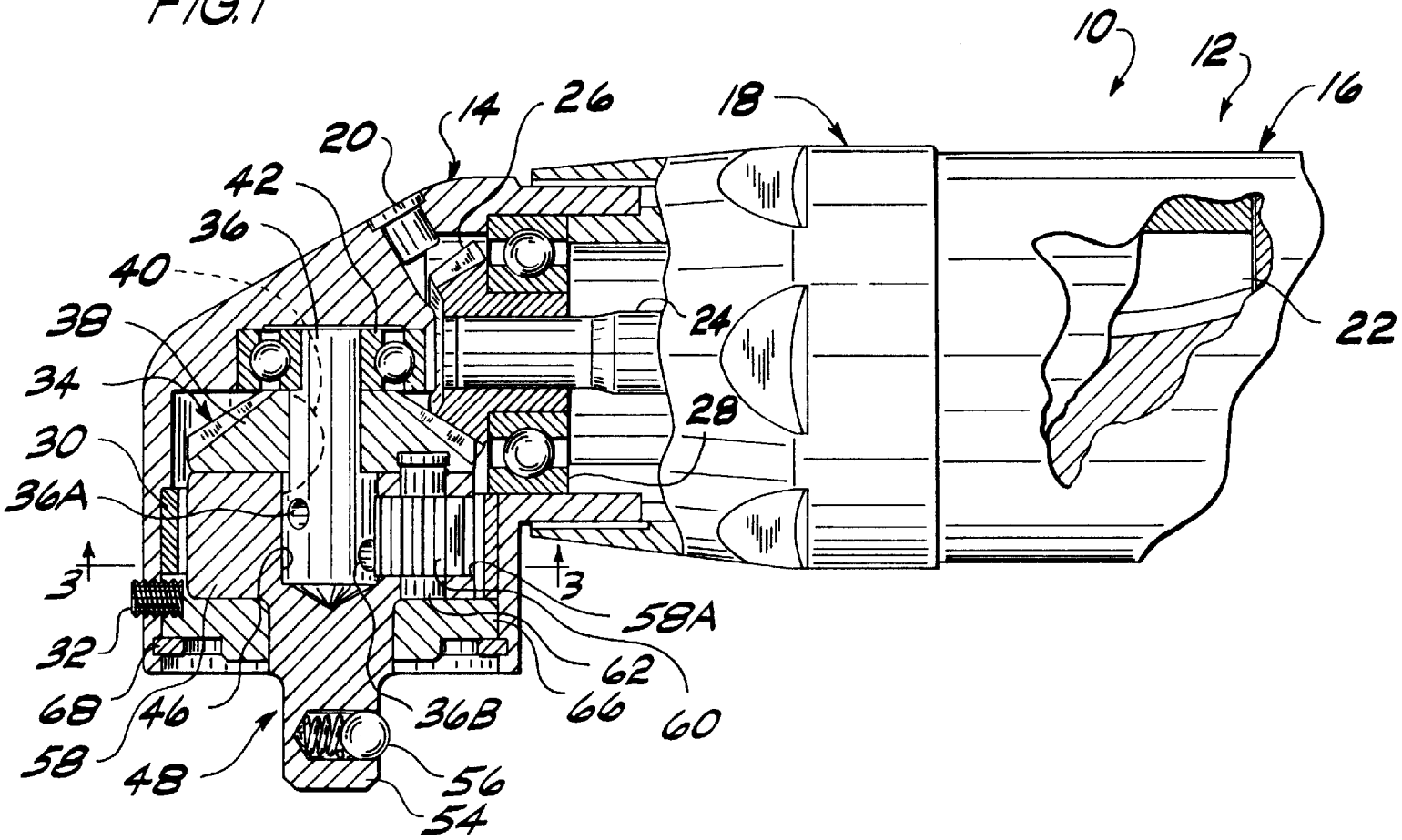
FIG. 1 is a fragmentary side elevational view of a powered tool of the present invention showing a ratchet head assembly of the tool in section.
Figure 5:
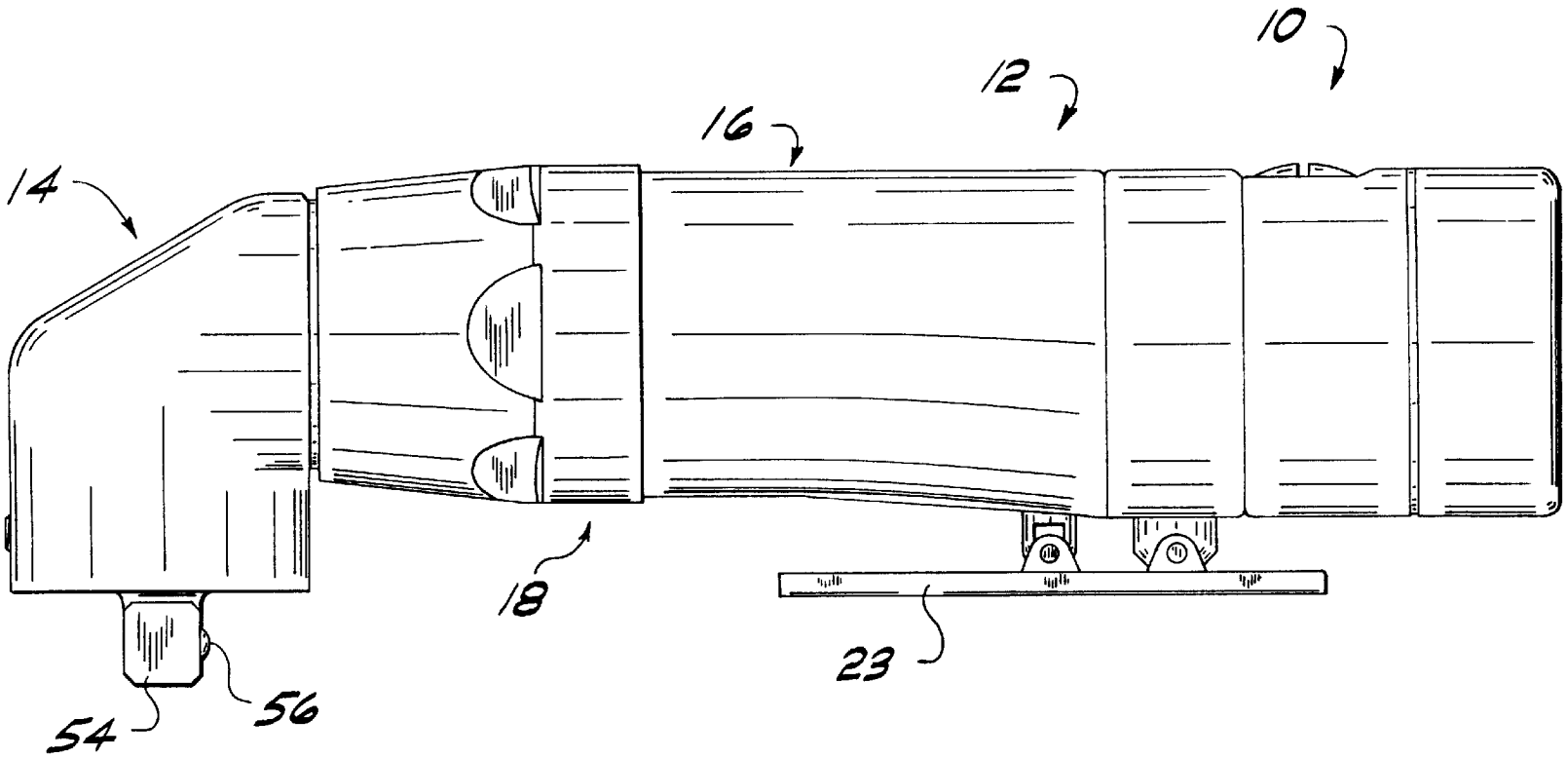
FIG. 5 is a side elevational view of the powered tool.

Referring now to the drawings and in particular to FIGS. 1 and 5, a powered wrench 10 of the present invention is shown to comprise a housing 12 including a head 14, a body 16 and a collar 18 interconnecting the head and body (the reference numbers designating their subjects generally). The head 14 is shown as a piece separate from the body 16, but could be formed as one piece with the body (i.e., without the collar 18). Moreover, the head itself could be formed of several pieces attached together. A cap 20 closes a lubrication opening in the head 14. The wrench 10 illustrated in the drawings is a pneumatic wrench having a reversible air motor 22 located within the body 16. The motor 22 is actuated by a lever 23 connected to a reversing valve (not shown) within the wrench 10. Examples of such reversing valves are shown in U.S. Pat. No. 5,423,350 and my co-pending U.S. application Ser. No. 60/111,184, filed Dec. 7, 1998, the disclosure of which is incorporated herein by reference. A drive shaft 24 connected to the motor 22 for rotation by the motor has a first bevel gear 26 at its upper end. The first bevel gear and shaft are received in a bearing 28 at the upper end. It is to be understood that although a tool having a pneumatic motor 22 is shown, a tool may have other types of motors, such as an electric motor (battery powered or otherwise) or a hydraulic motor, without departing from the scope of the present invention.

Figure 2:
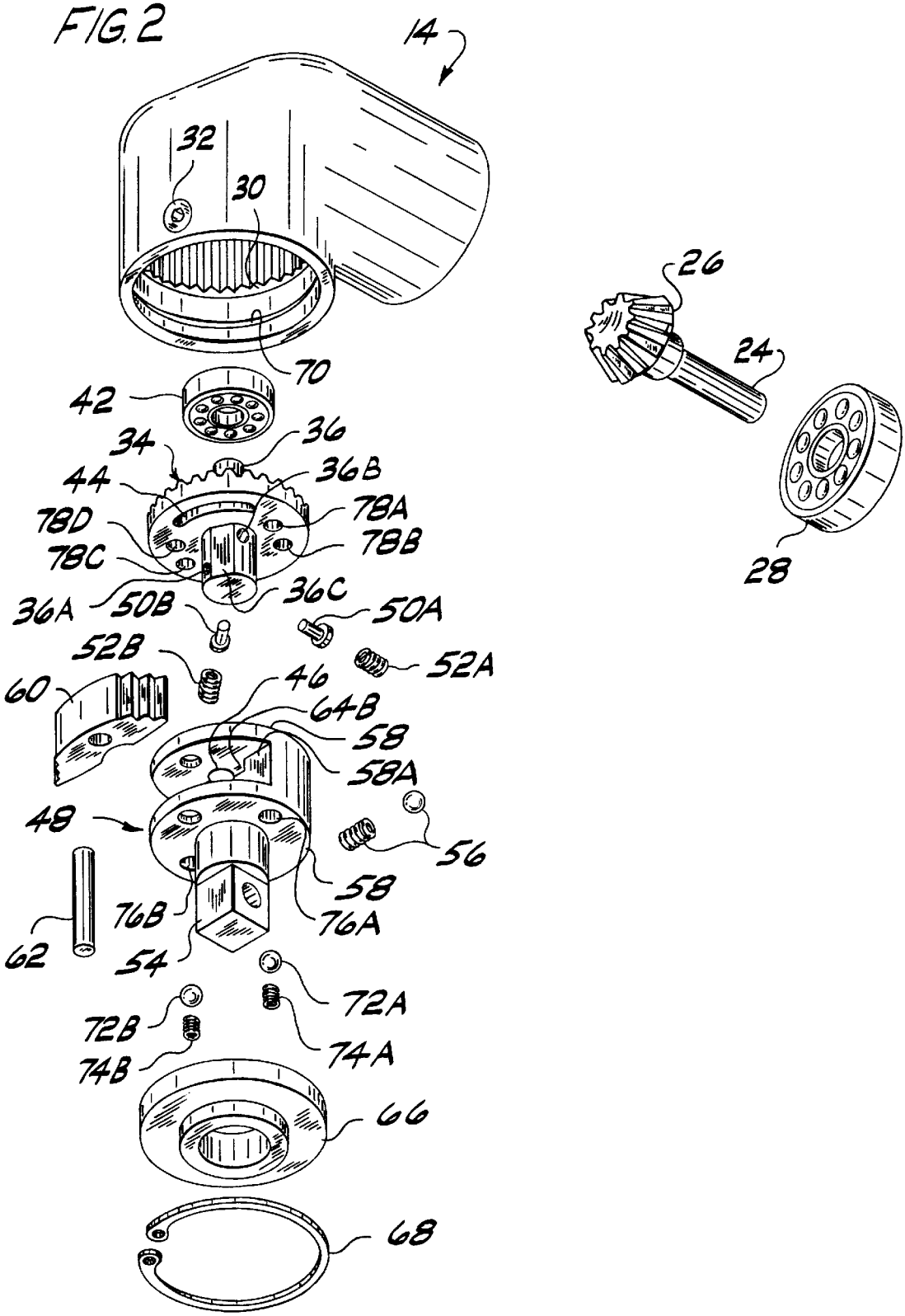
FIG. 2 is an exploded perspective view of the ratchet head assembly.
Figure 3:
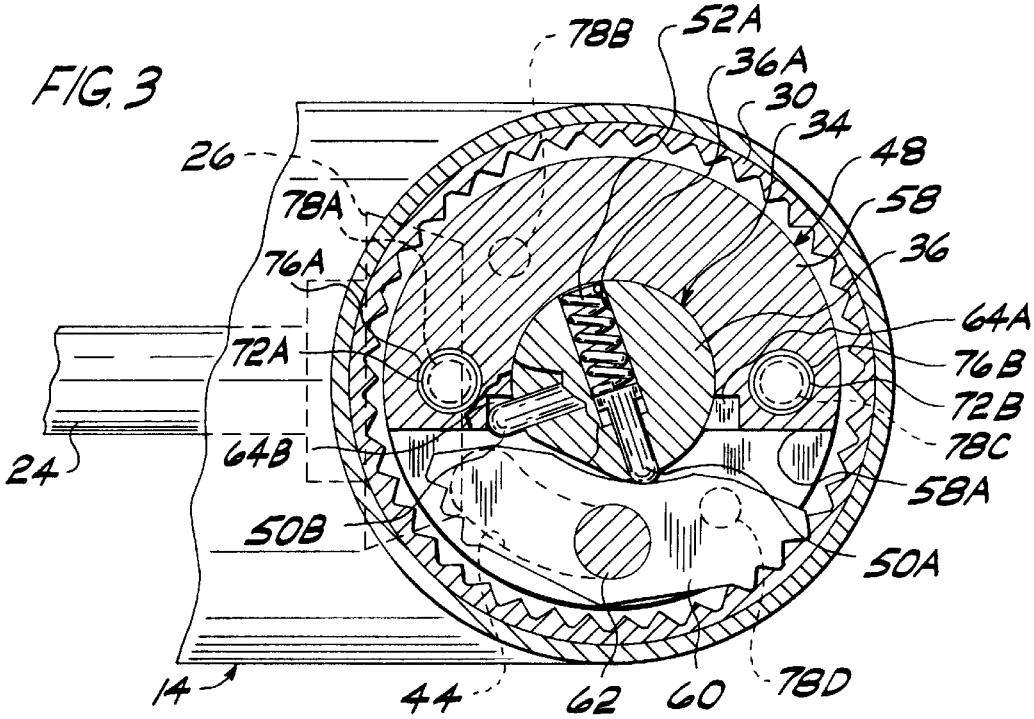
FIG. 3 is a fragmentary section taken in the plane including line 3—3 of FIG. 1 and showing a pawl in a first position.

A reversible ratchet assembly of the wrench 10 comprises the hollow head 14 of the housing 12, and further includes a ratchet gear ring 30 fixedly mounted on the inside of the head by a set screw 32. The ratchet gear ring 30 is formed as a separate piece and inserted into the head 14, but could be formed in other ways such as by machining the teeth into the material of the head. A reversal actuator generally indicated at 34 comprises a shaft 36 and a second bevel gear 38 affixed to the shaft by a key 40. The shaft 36 is received in a bearing 42 mounted in the head 14 for rotation of the reversal actuator 34 about the longitudinal axis of the shaft. The second bevel gear 38 extends radially outwardly from the shaft 36 and has an arcuate groove 44 on its outer face (see FIG. 2). The second bevel gear 38 is enmeshed with the first bevel gear 26 of the drive shaft 24 such that the reversal actuator 34 is directly driven by the drive shaft. The end of the shaft 36 opposite the bearing 42 is received in an opening 46 in an output shaft assembly (indicated generally at 48) and is concentric with the output shaft assembly. The shaft 36 has two radial bores 36A, 36B which are axially separate from each other and which are angularly offset at an angle of about 100°. Referring to FIGS. 2 and 3, reversing fingers (designated 50A, 50B, respectively) are received in respective ones of the radial bores 36A, 36B and project outwardly from the bores. Springs 52A, 52B received in the radial bores 36A, 36B bear at one end against the output shaft assembly 48 within the opening 46 and against respective reversing fingers 50A, 50B at the other end to bias the fingers to project radially outwardly from the radial bores. Each radial bore 36A, 36B has been counterbored so that a shoulder formed on one end of each reversing finger 50A, 50B engages the output shaft assembly 48 within the radial bore to hold the finger in the bore.

The output shaft assembly 48 includes an output shaft 54 projecting outwardly from the head 14 and constructed to receive attachments, such as a socket (not shown), for driving rotation of the attachment. In the illustrated embodiment, the output shaft 54 has a conventional ball and spring retention unit 56 for releasably holding the attachment on the output shaft. The output shaft assembly 48 has a wide base 58 located in the head 14 and an arcuate slot 58A on one side thereof receiving a ratchet pawl 60. The pawl is pivotally mounted on the base 58 in the arcuate slot 58A by a pin 62 which permits the pawl 60 to pivot relative to the base on the pin about an axis which is parallel to an axis of rotation of the output shaft assembly 48. The pawl 60 is elongate and has ratchet teeth formed in its opposite longitudinal ends. The teeth at the opposite ends of the pawl 60 are alternatively engageable with the teeth of the ratchet gear ring 30 by pivoting of the pawl on the pin 62 to interconnect the output shaft assembly 48 and the ratchet gear ring for manual ratcheting operation of the wrench 10 in different directions, as will be described below. The pin 62 extends out of the arcuate slot 58A through the base 58 on an inner face of the base and into the arcuate groove 44 in the second bevel gear 38 of the reversal actuator 34. The pin 62 and groove 44 are the only structures in the illustrated embodiment which interconnect the reversal actuator 34 and the output shaft assembly 48 to positively limit their relative rotation. However, different configurations (not shown) for interconnection of the reversal actuator 34 and output shaft assembly 48 are possible without departing from the scope of the invention. For instance, a second pin associated with the output shaft assembly and a second arcuate groove associated with the second bevel gear could be provided for additional strength. Moreover, a pin or pins could be associated with the reversal actuator and a groove or grooves with the output shaft assembly. The pin might also be formed integrally (e.g., as a tab) with either the output shaft assembly or reversal actuator without departing from the scope of the present invention.

The opening 46 in the output shaft assembly 48 which receives the shaft 36 of the reversal actuator 34 also opens into the arcuate slot 58A in the base 58 of the output shaft assembly. The shaft 36 is partially exposed in the arcuate slot 58A proximately to the pawl 60. A flat 36C formed on the shaft provides clearance for pivoting of the pawl 60 and turning of the shaft. In addition, the reversing fingers 50A, 50B of the reversal actuator 34 project out of their radial bores 36A, 36B into the arcuate slot 58A. The reversing fingers 50A, 50B are alternately engageable with the pawl 60 upon relative rotation between the reversal actuator 34 and output shaft assembly 48 to pivot the pawl on the pin 62. The shaft 36 is also initially engageable with the pawl near the edges of the flat 36C to positively force the teeth of the pawl out of engagement with the ratchet gear ring 30. Two cutouts 64A, 64B (FIG. 3) at the bottom of the arcuate slot 58A are capable of receiving respective ones of the reversing fingers 50A, 50B, and provide the room for the full range of motion of the fingers. As will be apparent from the description of the operation hereinafter, the reversing fingers 50A, 50B pivot the pawl 60 upon reversal of the motor 22 so that the direction of ratcheting is automatically changed when the motor is reversed.

A cover 66 received in the head 14 overlies the base 58 of the output shaft assembly 48 and has an opening through which the output shaft 54 projects out of the head. The cover 66, output shaft assembly 48 and reversal actuator 34 are held in the head 14 by a snap ring 68 received in an annular groove 70 in the head. The cover 66 also holds a pair of releasable locking balls 72A, 72B and associated springs 74A, 74B in respective holes 76A, 76B through the base 58 of the output shaft assembly 48. The springs 74A, 74B engage the cover 66 at the outer face of the base 58 and bias their corresponding balls 72A, 72B out of the holes 76A, 76B at the inner face of the base against the outer face of second bevel gear 38. Four recesses (designated 78A–78D, respectively) formed in the outer face of the second bevel gear 38 are capable of receiving the balls 72A, 72B to releasably lock the reversal actuator 34 and output shaft assembly together in two selected positions. However, the bias of the springs 74A, 74B can be overcome to lift the balls 72A, 72B out of the recesses to permit relative rotation of the reversal actuator 34 within the output shaft assembly base 58 to toggle the pawl 60.

Having described the construction of the powered wrench 10, its operation will now be described with particular reference to FIGS. 3 and 4. FIG. 3 shows the relative configuration of the reversal actuator 34 and output shaft assembly 48 when the wrench 10 is operating to turn the output shaft assembly in a clockwise direction. The reversing finger 50A engages the pawl 60 to the right of the pin 62, resiliently biasing the right end of the pawl against the ratchet gear ring 30 in a first position. The pin 62 engages the reversal actuator 34 in the right end of the arcuate groove 44 so that driven clockwise rotation of the reversal actuator pulls the pin, and hence the output shaft assembly 48, in conjoint clockwise rotation. Engagement of the right end of the pawl 60 with the ratchet gear ring 30 permits clockwise rotation of the output shaft assembly 48 within the head 14, but prevents counterclockwise rotation. If the torque capacity of the motor 22 is exceeded and manual operation is desired, the housing 12 including the head 14 can be turned clockwise to continue clockwise turning of the output shaft assembly 48. Clockwise movement of the head 14 will drive the teeth of the ratchet gear ring 30 into gripping engagement with the teeth on the right end of the pawl 60 so that the pawl holds the head and output shaft assembly 48 together for conjoint rotation in the clockwise direction.

Conventional ratcheting operation is also permitted, allowing the fastener (not shown) to be turned by an oscillating motion of the housing 12 in the fashion of a manual ratchet tool. Rotation of the head 14 in a counterclockwise direction results in the pawl 60 pivoting on the pin 62 in a counterclockwise direction to release the interconnection of the output shaft assembly 48 and the head so that the housing 12 can be turned counterclockwise without turning the output shaft assembly. The reversing finger 50A engaging the pawl 60 continuously biases, by operation of the spring 52A, the pawl toward engagement with the ratchet gear ring 30 so that ratcheting engagement is maintained. The locking balls 72A, 72B are received in the recesses 78A, 78C of the second bevel gear 38 of the reversal actuator 34 in the FIG. 3 position. The locking balls 72A, 72B hold the reversal actuator 34 together with the output shaft assembly 48 when the housing 12 is being turned counterclockwise so that the reversing finger 50A maintains its position for biasing the pawl 60 into engagement with the ratchet gear ring 30. Relative motion between the reversal actuator 34 and the output shaft assembly 48 when torque is released by counterclockwise movement of the housing 12 could cause the pawl 60 to pivot in such a fashion as to jam the wrench 10 or otherwise cause improper operation of the ratchet head assembly.

Figure 4:
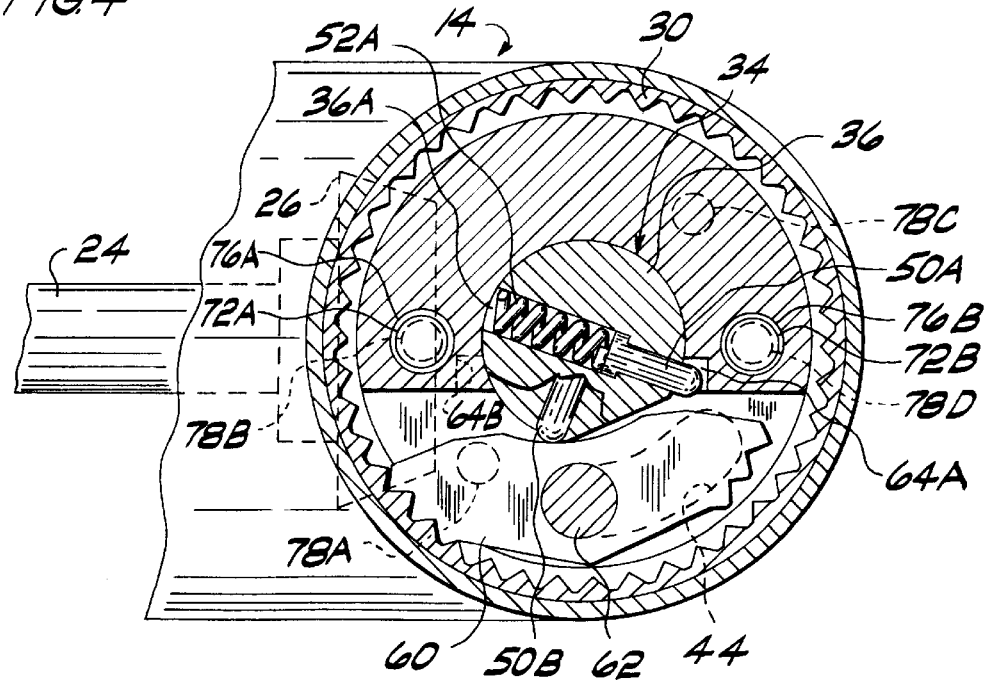
FIG. 4 is the section of FIG. 3 showing the pawl in a second position.

It will be readily apparent that when the reversal actuator 34 and output shaft assembly 48 are in the configuration shown in FIG. 4, the wrench housing 12 may be used to drive the output shaft 54 in a counterclockwise direction. Independent rotation of the head 14 relative to the output shaft assembly 48 is now permitted in the clockwise direction for manual ratcheting operation of the wrench 10. In the FIG. 4 configuration, the reversing finger 50B now engages the pawl 60 to pivot the left end of the pawl into engagement with the ratchet gear ring 30 in a second position. The locking balls 72A, 72B are now received in the recesses 78B, 78D of the reversal actuator 34 to hold the reversal actuator and output shaft assembly 48 against relative rotation.

Changeover from the driven clockwise rotation of the output shaft assembly 48 illustrated in FIG. 3 to the driven counterclockwise rotation driven in FIG. 4 occurs automatically upon reversal of the motor 22. Rotation of the reversal actuator 34 in a counterclockwise direction by operation of the motor 22 has sufficient torque to force the locking balls 72A, 72B out of the recesses 78A, 78C in the second bevel gear 38 so that the reversal actuator may turn relative to the output shaft assembly 48. Relative rotation is also permitted by the arcuate groove 44 in the second bevel gear 38 which moves counterclockwise under the pin 62. The extent of relative rotation of the reversal actuator 34 relative to the output shaft assembly 48 is limited to the arc of the groove 44. Once the left end of the groove 44 contacts the pin 62 (as in FIG. 4), continued counterclockwise rotation of the reversal actuator 34 results in conjoint counterclockwise rotation of the output shaft assembly 48. At the same time the left end of the groove 44 engages the pin 62, the balls 72A, 72B fall into the recesses 78B, 78D to releasably lock the reversal actuator 34 and the output shaft assembly 48 against inadvertent relative rotation.

As the reversal actuator 34 moves counterclockwise from the FIG. 3 configuration, the reversing finger 50A engaging the pawl 60 moves counterclockwise out of engagement with the pawl and into the cutout 64A (see FIG. 4). Simultaneously, the reversing finger 50B moves out of its cutout 64B and into engagement with the left end of the pawl 60. Just before the finger 50B engages the pawl 60, the shaft 36 engages the pawl at the left edge of the flat 36C. The shaft provides a strong force to push the pawl 60 out of engagement with the teeth of the ratchet gear ring 30. It is envisioned that either the fingers 50A, 50B alone or the shaft 36 alone could be used to reverse the pawl. However, if only the shaft is used, some other structure (not shown) to resiliently bias the pawl 60 into engagement with the ratchet gear ring would be needed. Continued counterclockwise movement of the reversing finger 50B pivots the pawl 60 in a counterclockwise direction on the pin 62 so that the teeth on the left end of the pawl engage the teeth of the ratchet gear ring 30. The reversing finger 50B now resiliently biases the left end of the pawl 60 into engagement with the ratchet gear ring 30 in the same way as the reversing finger 50A did in the FIG. 3 configuration.

It will be readily apparent from the foregoing description how the pawl 60 will be automatically reversed back to the FIG. 3 configuration for clockwise driven rotation from the configuration of FIG. 4. Accordingly, no further description will be provided.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense. In addition to the different embodiments described above, at least three other variants (not shown) within the scope of the present invention are envisioned. A tool which is entirely straight (e.g., a ratcheting screwdriver) could be constructed, so that no right angle transmission of the motor rotation would be necessary. In that event, the reversal actuator could be part of the output shaft and not a distinct element. The ratchet head assembly could also be incorporated into a conventional oscillating yoke ratchet tool. The yoke would replace the fixed ratchet ring 30 of the illustrated embodiment for engagement with the pawl to drive rotation of the output shaft assembly. The reversal actuator would not be connected to the motor at all, but would instead extend outward to a knob which could be manually turned to achieve reversal of the tool. The ratchet head assembly is readily applicable to a totally manual tool (i.e., having no motor). The reversal actuator would be connected to a knob to change direction of operation of the tool. The ratchet gear ring would be fixed within the head of the tool, substantially as in the illustrated embodiment. The construction of the ratchet assembly permits the knob to be turned to position the pawl for driven rotation in the same direction as the knob is turned. In other words, when the knob is turned clockwise, the operator immediately knows that driven rotation will be in the clockwise direction and vice versa.

What is claimed is:

1. A powered tool capable of operating as a manual ratchet tool, the powered tool comprising:

a housing including a head and ratchet teeth disposed internally of the head;

a reversible motor in the housing;

a reversal actuator mounted in the housing and operatively connected to the motor to be driven in rotation by the motor;

an output shaft assembly generally in the head of the housing, the output shaft assembly being attached to the reversal actuator for rotation of the reversal actuator relative to the output shaft assembly in a first direction over an arc and for conjoint rotation with the reversal actuator in the first direction after rotation over the arc in the first direction, and for rotation of the reversal actuator relative to the output shaft assembly in a second direction opposite the first direction over the arc and for conjoint rotation with the reversal actuator in the second direction after rotation over the arc in the second direction, whereby the attachment of the output shaft assembly to the reversal actuator allows rotation of the reversal actuator relative to the output shaft assembly over the arc to occur upon reversal of the motor, the output shaft assembly further comprising a ratchet pawl pivotally mounted on the output shaft assembly and engageable with the ratchet teeth on the head, the pawl being pivotable between a first position in which the pawl engages the ratchet teeth to hold the output shaft assembly and head together for conjoint rotation in one direction and permit relative rotation between the output shaft assembly and the head in another direction opposite said one direction, and a second position in which the pawl engages the ratchet teeth to hold the output shaft assembly and head together for conjoint rotation in said other direction and to permit relative rotation between the output shaft assembly and the head in said one direction thereby to permit manual ratcheting operation of the tool;

the reversal actuator being adapted to engage the pawl for pushing the pawl between said first and second positions upon relative rotation between the output shaft assembly and the reversal actuator whereby manual ratcheting is automatically reversed upon reversal of the motor.

2. A powered tool as set forth in claim 1 wherein the reversal actuator comprises a first finger engageable with the pawl for pushing the pawl from the first position to the second position upon rotation of the reversal actuator relative to the output shaft assembly in the first direction, and a second finger engageable with the pawl for pushing the pawl from said second position to said first position upon rotation of the reversal actuator relative to the output assembly in the second direction.

3. A powered tool as set forth in claim 2 wherein the reversal actuator further comprises a radial bore in the reversal actuator for each of the first and second fingers, the first and second fingers being received in respective radial bores, the reversal actuator further including springs in each of the radial bores for biasing the first and second fingers outwardly of the bores.

4. A powered tool as set forth in claim 3 wherein the reversal actuator comprises a shaft having the first and second radial bores therein, the shaft being disposed relative to the pawl whereby the shaft engages the pawl upon relative rotation of the reversal actuator and the output shaft assembly to disengage the pawl from the ratchet teeth.

5. A powered tool as set forth in claim 1 wherein one of the reversal actuator and the output shaft assembly has an arcuate groove therein, and the other of the reversal actuator and output shaft assembly has a pin affixed thereto and received in the arcuate groove for attachment of the output shaft assembly to the reversal actuator.

6. A powered tool as set forth in claim 5 wherein the pin is affixed to the output shaft assembly and the arcuate groove is in the reversal actuator, the ratchet pawl being pivotally mounted on the pin.

7. A powered tool as set forth in claim 1 further comprising a resilient, yieldable lock adapted to interconnect the output shaft assembly and the reversal actuator to inhibit relative rotation between the output shaft assembly and the reversal actuator unless the motor is reversed.

8. A powered tool as set forth in claim 7 wherein the lock comprises a ball and a spring disposed in a first receptacle associated with the output shaft assembly, the spring biasing the ball outwardly of the first receptacle, the ball being receivable in a second receptacle in the reversal actuator when the first and second receptacles are aligned for yieldably resisting relative rotation of the output shaft assembly and the reversal actuator.

9. A powered tool as set forth in claim 8 wherein the lock comprises a third receptacle in the reversal actuator, the ball being receivable in the third receptacle when the first and third receptacles are aligned for yieldably resisting relative rotation of the output shaft assembly and the reversal actuator.

10. A powered tool as set forth in claim 1 further comprising a drive shaft connected to the motor for rotation by the motor, the drive shaft being in direct driving engagement with the reversal actuator.

11. A powered tool as set forth in claim 1 wherein the reversal actuator comprises a shaft disposed relative to the pawl whereby the shaft engages the pawl upon relative rotation of the reversal actuator and the output shaft assembly to disengage the pawl from the ratchet teeth.

12. A reversible ratchet head assembly comprising:

a head and ratchet teeth disposed internally of the head;

a reversal actuator mounted for rotation in the housing;

an output shaft assembly in the head, the output shaft assembly being attached to the reversal actuator for rotation of the reversal actuator relative to the output shaft assembly, the output shaft assembly further comprising a ratchet pawl pivotally mounted on the output shaft assembly and engageable with the ratchet teeth on the head, the pawl being pivotable between a first position in which the pawl engages the ratchet teeth to hold the output shaft assembly and head together for conjoint rotation in a first direction and to permit relative rotation between the output shaft assembly and the head in a second direction, and a second position in which the pawl engages the ratchet teeth to hold the output shaft assembly and head together for conjoint rotation in the second direction and to permit relative rotation between the output shaft assembly and the head in the first direction;

the reversal actuator being constructed to engage the pawl upon rotation of the reversal actuator relative to the output shaft assembly in the first direction to move the pawl to the first position and constructed to engage the pawl upon rotation of the reversal actuator relative to the output shaft assembly in the second direction to move the pawl to the second position, the reversal actuator comprising a first finger adapted to project radially outwardly from the reversal actuator for engaging the pawl to move the pawl to the first position upon rotation of the reversal actuator relative to the output shaft assembly in the first direction, and a second finger adapted to project radially outwardly from the reversal actuator for engaging the pawl to move the pawl to the second position upon rotation of the reversal actuator relative to the output shaft assembly in the second direction.

13. A reversible ratchet head assembly as set forth in claim 12 wherein the reversal actuator has a first radial bore receiving the first finger therein and a second radial bore receiving the second finger therein, the reversal actuator further comprising a first spring in the first bore biasing the first finger outwardly from the first bore and a second spring in the second bore biasing the second finger outwardly from the second bore.

14. A powered tool as set forth in claim 13 wherein the reversal actuator comprises a shaft having the first and second radial bores therein, the shaft being disposed relative to the pawl whereby the shaft engages the pawl upon relative rotation of the reversal actuator and the output shaft assembly to disengage the pawl from the ratchet teeth.

15. A reversible ratchet head assembly as set forth in claim 12 further comprising a resilient, yieldable lock adapted to interconnect the output shaft assembly and the reversal actuator to inhibit relative rotation between the output shaft assembly and the reversal actuator upon relative movement of the head and the output shaft assembly.

16. A reversible ratchet head assembly as set forth in claim 15 wherein the lock comprises a ball and a spring disposed in a first receptacle associated with the output shaft assembly, the spring biasing the ball outwardly of the first receptacle, the ball being receivable in a second receptacle in the reversal actuator when the first and second receptacles are aligned with the pawl in the first position for yieldably resisting relative rotation of the output shaft assembly and the reversal actuator.

17. A reversible ratchet head assembly as set forth in claim 16 wherein the lock comprises a third receptacle in the reversal actuator, the ball being receivable in the third receptacle when the first and third receptacles are aligned with the pawl in the second position for yieldably resisting relative rotation of the output shaft assembly and the reversal actuator.

18. A reversible ratchet head assembly comprising:

a head and ratchet teeth disposed internally of the head;

a reversal actuator mounted for rotation in the head;

an output shaft assembly in the head, the output shaft assembly being attached to the reversal actuator for rotation of the reversal actuator relative to the output shaft assembly, the output shaft assembly further comprising a ratchet pawl pivotally mounted on the output shaft assembly and engageable with the ratchet teeth on the head, the pawl being pivotable between a first position in which the pawl engages the ratchet teeth to hold the output shaft assembly and head together for conjoint rotation in a first direction and to permit relative rotation between the output shaft assembly and the head in a second direction, and a second position in which the pawl engages the ratchet teeth to hold the output shaft assembly and head together for conjoint rotation in the second direction and to permit relative rotation between the output shaft assembly and the head in the first direction;

the reversal actuator being constructed to engage the pawl upon rotation of the reversal actuator relative to the output shaft assembly in the first direction to move the pawl to the first position and constructed to engage the pawl upon rotation of the reversal actuator relative to the output shaft assembly in the second direction to move the pawl to the second position;

the reversal actuator comprising a shaft on which the reversal actuator rotates relative to the output shaft assembly, the shaft being disposed relative to the pawl whereby the shaft engages the pawl upon relative rotation of the reversal actuator and the output shaft assembly to disengage the pawl from the ratchet teeth.

19. A reversible ratchet head assembly comprising:

a head and ratchet teeth disposed internally of the head;

a reversal actuator mounted for rotation in the head;

an output shaft assembly in the head, the output shaft assembly being attached to the reversal actuator for rotation of the reversal actuator relative to the output shaft assembly, the output shaft assembly further comprising a ratchet pawl pivotally mounted on the output shaft assembly and engageable with the ratchet teeth on the head, the pawl being pivotable between a first position in which the pawl engages the ratchet teeth to hold the output shaft assembly and head together for conjoint rotation in a first direction and to permit relative rotation between the output shaft assembly and the head in a second direction, and a second position in which the pawl engages the ratchet teeth to hold the output shaft assembly and head together for conjoint rotation in the second direction and to permit relative rotation between the output shaft assembly and the head in the first direction;

the reversal actuator being constructed to engage the pawl upon rotation of the reversal actuator relative to the output shaft assembly in the first direction to move the pawl to the first position and constructed to engage the pawl upon rotation of the reversal actuator relative to the output shaft assembly in the second direction to move the pawl to the second position;

a groove associated with one of the reversal actuator and output shaft assembly, and a projecting member associated with the other of the reversal actuator and output shaft assembly, the projecting member being received in the groove, the projecting member being movable in the groove between ends thereof to permit relative rotation of the reversal actuator and output shaft assembly, the projecting member interengaging the reversal actuator and output shaft assembly at ends of the groove for conjoint rotation of the reversal actuator and output shaft assembly.

20. A reversible ratchet head assembly as set forth in claim 19 in combination with a powered tool, the powered tool comprising a housing, a reversible motor in the housing and operatively connected to the reversal actuator for driving rotation thereof, the reversal actuator moving relative to the output shaft assembly upon reversal of direction of the motor.

* * * * *